US005891786A

United States Patent [19]

Srinivasan et al.

[11] Patent Number: 5,891,786

[45] Date of Patent: Apr. 6, 1999

[54] SUBSTANTIALLY METAL FREE SYNTHETIC POWER TRANSMISSION FLUIDS HAVING ENHANCED PERFORMANCE CAPABILITIES

[75] Inventors: Sanjay Srinivasan, Midlothian; David W. Smith, Richmond, both of Va.

[73] Assignee: Ethyl Corporation, Richmond, Va.

[21] Appl. No.: 371,722

[22] Filed: Jan. 12, 1995

[51] Int. Cl.[6] ..... C10M 141/02

[52] U.S. Cl. ..... 508/188; 508/465

[58] Field of Search ..... 508/188, 465

[56] References Cited

U.S. PATENT DOCUMENTS

| | | | |
|---|---|---|---|
| 3,668,236 | 6/1972 | Cyba | 252/51.5 A |
| 4,382,006 | 5/1983 | Horodysky | 252/51.5 R |
| 4,409,000 | 10/1983 | Le Suer | 252/51.5 R |
| 4,704,217 | 11/1987 | Sweeney et al. | 252/51.5 R |
| 5,078,893 | 1/1992 | Ryer et al. | 252/51.1 R |
| 5,089,156 | 2/1992 | Chrisope et al. | 252/51.5 A |
| 5,286,394 | 2/1994 | Moore | 252/51.1 R |
| 5,348,670 | 9/1994 | McDonald et al. | 252/51 A |
| 5,360,562 | 11/1994 | Chrisope et al. | 252/216.6 |
| 5,372,735 | 12/1994 | Ohlani et al. | 252/51.5 R |

FOREIGN PATENT DOCUMENTS 646639 4/1995 European Pat. Off. .

*Primary Examiner*—Jacqueline V. Howard
*Attorney, Agent, or Firm*—Dennis H. Rainear

[57] ABSTRACT

The fluids have an oil-soluble boron content of about 0.001 to about 0.1%, an oil-soluble phosphorus content of about 0.005 to about 0.2%, and either no metal additive content or an oil-soluble metal content as one or more metal-containing additives of no more than about 100 ppm. Included in the fluids are: (a) at least 70 wt % of hydrogenated poly-α-olefin oligomer fluid with a viscosity in the range of 2–6 cSt at 100° C.; (b) 2–20 wt % of acrylic viscosity index improver; (c) 4–25 wt % of oil-soluble dialkyl ester of a $C_4$ to $C_{14}$ α,ω-dicarboxylic acid with a pour point of −45° C. or lower; (d) ashless dispersant; (e) friction modifier; and (f) oil-soluble inhibitors. The components are such that the fluid has (i) a KV of at least 6.8 cSt at 100° C., (ii) a BV of 15,000 cP or less at −40° C., (iii) a KV at 100° C. of at least 6.0 cSt after 4 hours and at least 5.0 cSt after 20 hours in the Volkswagen taper roller bearing shear stability test. The fluids possess other excellent performance properties.

25 Claims, 6 Drawing Sheets

SUBSTANTIALLY METAL FREE SYNTHETIC POWER TRANSMISSION FLUIDS HAVING ENHANCED PERFORMANCE CAPABILITIES

TECHNICAL FIELD

This invention relates to oil-based power transmission fluid compositions, especially automatic transmission fluids, of enhanced performance capabilities.

BACKGROUND

The continuing development of new power transmission equipment gives rise to demands for new automatic transmission fluids capable of meeting increasingly severe performance requirements sought by the original equipment manufacturers and marketers of power transmission fluids. Among significant improvements in this regard are the ashless or low-ash synthetic base compositions described in U.S. Pat. Nos. 5,089,156 and 5,360,562 to D. R. Chrisope and R. J. Hartley. Those compositions, which utilize among other things mixtures of certain high and low viscosity hydrogenated poly-α-olefin oligomers and little or no high molecular weight viscosity index improvers, have excellent high and low temperature viscosity properties and excellent shear stability. Nevertheless, further progress in the field requires compositions which not only possess these properties, but which in addition exhibit superior seal performance and superior friction properties.

SUMMARY OF THE INVENTION

It has been found possible to fulfill the foregoing need while at the same time providing automatic transmission fluids that are advantageous from the environmental and economic standpoints. Pursuant to this invention fluids are provided which have little or no content of metals, and the small amount of metal if present is typically an innocuous metal such as calcium. At the same time it has been found possible to achieve substantial improvements in seal and friction performance through use of a synthetic base oil of relatively low viscosity provided such base such is suitably combined with particular additive components hereinafter described.

In accordance with this invention there is provided a power transmission fluid (ATF) composition wherein the composition has on a weight basis an oil-soluble boron content of about 0.001 to about 0.1%, an oil-soluble phosphorus content of about 0.005 to about 0.2%, and either no metal additive content or an oil-soluble metal content as one or more metal-containing additives of no more than about 100 ppm; wherein said composition comprises the following components:

a) at least about 70 wt % based on the total weight of said composition of one or more hydrogenated poly-α-olefin oligomer fluids, this component having a viscosity in the range of about 2 to about 6 cSt at 100° C.;

b) on an active ingredient basis, about 2 to about 20 wt % based on the total weight of said composition of an acrylic viscosity index improver in the form of a solution in an inert solvent;

c) about 4 to about 25 wt % based on the total weight of said composition of at least one oil-soluble dialkyl ester of a $C_4$ to $C_{14}$ α,ω-dicarboxylic acid having a pour point of −45° C. or lower;

d) a dispersant amount of at least one oil-soluble ashless dispersant;

e) a friction modifying amount of at least one oil-soluble friction modifier; and f) oil-soluble inhibitors selected from the group consisting of foam inhibitors, copper corrosion inhibitors, rush inhibitors, and oxidation inhibitors.

In addition, the components referred to above are selected and combined such that finished composition has (i) a kinematic viscosity of at least 6.8 cSt at 100° C., (ii) a Brookfield viscosity of 15,000 cP or less at −40° C., (iii) a kinematic viscosity at 100° C. of at least 6.0 cSt after 4 hours in the Volkswagen taper roller bearing shear stability test, and (iv) a kinematic viscosity at 100° C. of at least 5.0 cSt after 20 hours in the Volkswagen taper roller bearing shear stability test.

FURTHER DESCRIPTION OF THE INVENTION

Figure 1:
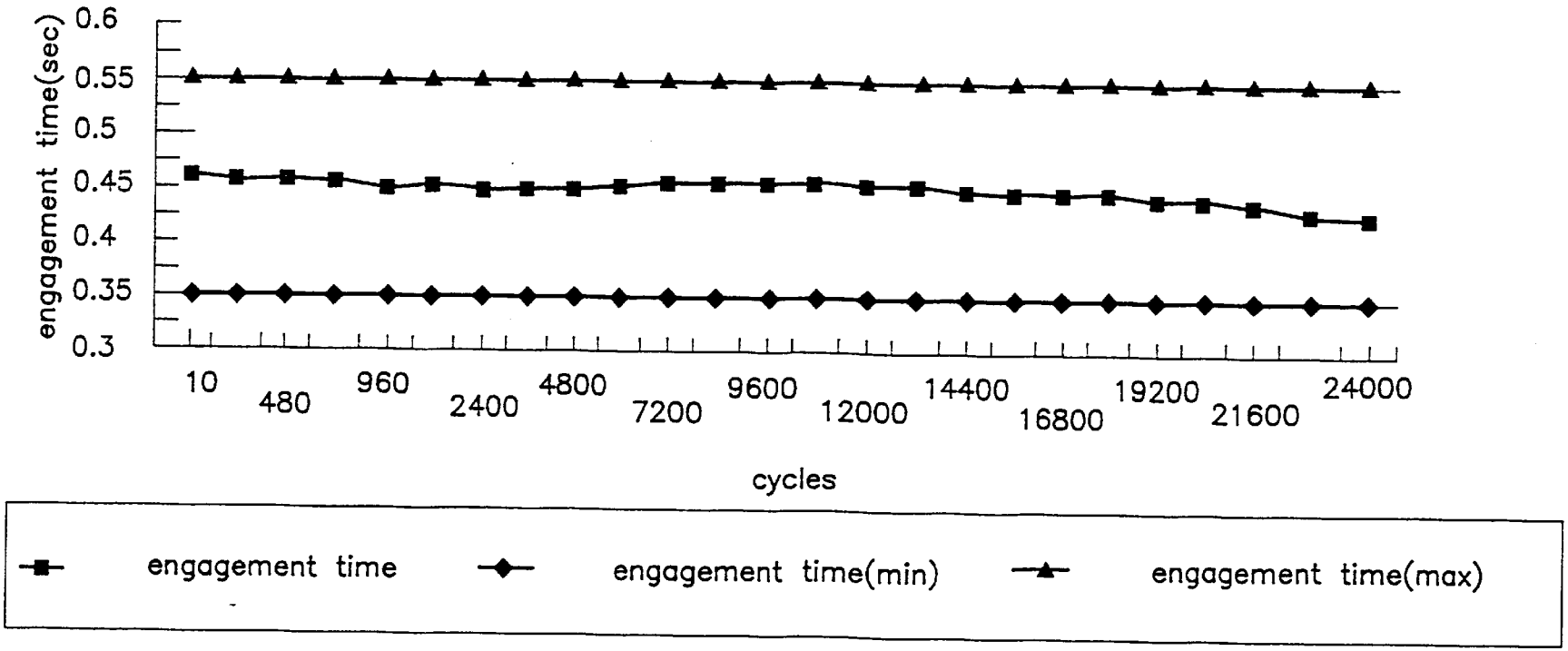
FIGS. 1 through 6 are plots of data obtained on subjecting two different ATF compositions of this invention to the 3T40 baud clutch friction test procedure of General Motors Corporation.

Although the fluid compositions of this invention contain on a weight basis from none to no more than about 100 ppm (parts per million) of metals, these compositions do contain one or more components containing boron or phosphorus or a combination of boron and phosphorus, which elements of course are not classified as metals. Likewise small amounts of silicon in the form of silicone foam inhibitor may be, and preferably are, present in the compositions.

Among the features of this invention is the discovery that the type of hydrogenated poly-α-olefin oligomer fluid used can have a profound influence on the seal performance of the finished automatic transmission fluid. In particular, hydrogenated poly-α-olefin oligomer fluids having 100° C. kinematic viscosities of 8, 10, 40 and 100 cSt tend to cause seal shrinking, especially in the case of ethylene-acrylic seal material and silicone seal material. In sharp contrast, the hydrogenated poly-α-olefin oligomer fluids used in the practice of this invention—viz., one or more hydrogenated poly-α-olefin oligomer fluids as a fluid having a 100° C. kinematic viscosity in the range of about 2 to about 6 cSt—do not exert this deleterious effect. In fact, use of these less viscous hydrogenated poly-α-olefin oligomer fluids makes it possible to provide finished automatic fluid compositions which can pass all of the seal tests set forth in the current DEXRON® III specifications of General Motors Corporation and all of the seal tests set forth in the current MERCON® specifications of Ford Motor Company, which compositions constitute preferred embodiments of this invention. The DEXRON® III specifications of General Motors Corporation referred to herein are as published in GM-6297M, dated April 1993, and the MERCON® specifications of Ford Motor Company referred to herein are as revised in February 1993.

Moreover, this invention makes possible the provision of power transmission fluid compositions having an excellent combination of properties including excellent low temperature and high temperature viscosity properties, high shear stability, excellent thermal and oxidative stability, excellent friction properties, highly effective antiwear and extreme pressure properties, and good additive compatibility. This is made possible in part because of the beneficial mutual co-action among the principal components used in formulating the compositions of this invention. For example, the unification of the herein-described components a), b) and c)

in the proportions set forth above makes it possible to achieve the vitally important high and low temperature viscosity properties, the sear stability properties, and the seal compatibility properties. The other components contribute to other advantageous properties, and at the same time do not materially detract from the excellent overall performance capabilities of the compositions.

It is important to note that prior general purpose lubricant compositions, crankcase lubricant compositions, gear lubricant compositions, metal working fluid cmpositions, cutting oil fluid compositions, slideway lubricant compositions, manual transmission fluid compositions, transformer oil compositions, hydraulic fluids, etc., cannot be used in the practice of this invention. The performance parameters which must be achieved and that have been achieved pursuant to this invention cannot be realized by any such compositions that have been designed, used or suggested for use for such other purposes. The present invention involves highly specialized automatic transmission fluid compositions, an area which is generally regarded in the art as constituting perhaps the most complex area of technology in the entire field of lubrication and power transmission fluids. The compositions of this invention are thus of greatest utility and are especially adapted for use as automatic transmission fluids, including use with the new generations of automatic transmission equipped with electronically controlled torque converter clutches capable of operating in a continuous slip mode. The compositions of this invention can also be used as hydraulic fluids, although all of the excellent performance capabilities of the present compositions are unnecessary for such usage.

Preferably, the ashless dispersant used in the compositions of this invention is a phosphorus-containing dispersant, and more preferably, a boron- and phosphorus-containing dispersant. In one embodiment the entire phosphorus and boron content of the finished fluid is supplied by a boron- and phosphorus-containing dispersant, such as a boron- and phosphorus-containing succinimide dispersant, a boron- and phosphorus-containing Mannich base dispersant, or the like. In another embodiment the entire boron content of the finished fluid is supplied by a boron- and phosphorus-containing dispersant whereas the phosphorus content is supplied in part by the boron- and phosphorus-containing dispersant and in part by a non-dispersant metal-free oil-soluble nitrogen- and phosphorus-containing antiwear/extreme pressure agent such as an amine phosphate, or the like. In this latter embodiment it is especially preferred to proportion these components such that a major amount of the phosphorus content in the finished fluid is supplied by the dispersant and a minor amount is supplied by the non-dispersant antiwear/extreme pressure agent.

The finished compositions preferably contain a combination of all of the inhibitors referred to above. Thus the preferred compositions contain at least one foam inhibitor, at least one copper corrosion inhibitor, at least one rush inhibitor, and at least one oxidation inhibitor. Each such inhibitor type, whether comprised of one or more individual component materials of that type, is present in an amount that is at least sufficient to provide the functional performance for which it has been selected. Thus in accordance with this preferred embodiment, the finished fluid will contain a foam-inhibiting amount of one or more foam inhibitors, a copper corrosion-inhibiting amount of one or more copper corrosion inhibitors, a rust-inhibiting amount of one or more rust inhibitors, and an oxidation-inhibiting amount of one or more oxidation inhibitors. In selecting these components it is important to ensure that the components are mutually compatible with each other, and that none of them significantly detracts from or interferes with the performance capabilities of the overall finished fluid composition.

In this connection, while other inhibitor components can be used, preferred compositions are those in which the oil-soluble inhibitors include at least one thiadiazole such as a 2-mercapto-5-alkyldithio-1,3,5-thiadiazole or 2,5-bis (alkyldithio)-1,3,5-thiadiazole, at least one ring-alkylated diphenylamine, at least one sterically-hindered tertiary butyl phenol, at least one calcium sulfurized alkylphenate, at least one alkyloxypropylamine, at least one aliphatic monocarboxylic acid, at least one alkyl glycol nonionic surfactant, and silicone foam inhibitor.

Still another feature of this invention is the discovery that the compositions of this invention should be devoid of sulfurized esters and sulfurized olefinic compounds. Elimination of such commonly used materials has been found to materially increase the thermal and oxidative stability of the overall composition. In a preferred embodiment of this invention, the only sulfur-containing additive components present are (i) 100 ppm or less (preferably 50 ppm or less) of alkaline earth metal such as calcium added as an alkaline earth metal sulfurized alkylphenate or alkaline earth metal alkylbenzene sulfonate, and/or (ii) a thiadiazole copper corrosion inhibitor, such as an oil-soluble 2-mercapto-5-alkyldithio-1,3,5-thiadiazole and/or an oil-soluble 2,5-bis (alkyldithio)-1,3,5-thiadiazole. To illustrate the foregoing, an ATF fluid composition of this invention containing both (i) and (ii) but devoid of any sulfurized ester or sulfurized olefinic compound not only will give passing results in the standard THOT test but will yield almost pristine transmission parts at the end of the test.

The compositions of this invention preferably include as friction modifier at least one N-aliphatic hydrocarbyl-substituted diethanol amine in which the N-aliphatic hydrocarbyl-substituent is at least one straight chain aliphatic hydrocarbyl group free of acetylenic unsaturation and having in the range of 14 to 20 carbon atoms. Other preferred friction modifiers which can be used include at least one N-aliphatic hydrocarbyl-substituted trimethylenediamine in which the N-aliphatic hydrocarbyl group is at least one straight chain aliphatic hydrocarbyl group free of acetylenic unsaturation and having in the range of about 14 to about 20 carbon atoms, or at least one hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms.

These and other embodiments and features of this invention will become still further apparent from the ensuing description and appended claims.

Component a)

As noted above, a major amount of the oleaginous liquids of this invention is compounded from one or more hydrogenated poly-α-olefin oligomer fluids. Such fluids are formed by oligomerization of 1-alkene hydrocarbon having 6 to 20 and preferably 8 to 16 carbon atoms in the molecule and hydrogenation of the resultant oligomer. Hydrogenated oligomers formed from 1-decene are particularly preferred. Commercially available products are usually composed of mixtures of individual oligomer species such as for example dimer, trimer and tetramer species. It is to be understood that the term "oligomer" does not place a limitation on the actual number of monomer units in the molecule, other than to distinguish the material from a higher polymer oil such as polyisobutene oils. In general however the hydrogenated poly-α-olefin oligomer fluids in the viscosity range of 2 to 6 cSt at 100° C. will usually not contain on a weight basis more than minor amounts (i.e., less than 50 wt %), if any, of species above hexamer.

Component a) whether a single species or a mixture of oligomeric species has a viscosity at 100° C. in the range of about 2 to about 6 cSt. Thus commercially available hydrogenated poly-α-olefin oligomer fluids sold as 40 cSt or 100 cSt hydrogenated poly-α-olefin oligomer fluid mixtures are not used in the practice of this invention.

Most preferably component a) is composed of either (i) a single hydrogenated poly-α-olefin oligomer fluid or (ii) a mixture of at least two different hydrogenated poly-α-olefin oligomer fluids, wherein the single fluid of (i) or the resultant mixture of (ii) has a kinematic viscosity at 100° C. in the range of about 4 to about 6 cSt, and better yet, a kinematic viscosity at 100° C. in the range of about 4.5 to about 5.5 cSt.

Methods for the production of such liquid oligomeric 1-alkene hydrocarbons are known and reported in the literature. See for example U.S. Pat. Nos. 3,763,244; 3,780,128; 4,172,855; 4,218,330; and 4,950,822. Additionally, hydrogenated 1-alkene oligomers of this type and of suitable viscosity grades are available as articles of commerce, for example, under the DURASYN trademark from Albemarle Corporation. Suitable 1-alkene oligomers are also available from other suppliers.

Tabulated below are data concerning typical composition and properties of products of this type made from 1-decene. In these tabulations the typical compositions are expressed in terms of normalized area percentages by GC and "n.d." means "not determined".

2 Centistoke poly-α-olefin oil:

Composition—Monomer 0.4, Dimer 90.7, Trimer 8.3, Tetramer 0.6.

Properties—Viscosity at 100° C.: 1.80 cSt; Viscosity at 40° C.: 5.54 cSt; Viscosity at −18° C.: n.d.; Viscosity at −40° C.: 306 cSt; Pour point: −63° C.; Flash point (ASTM D 92): 165° C.; NOACK volatility: 99%.

4 Centistoke poly-α-olefin oil:

Composition—Trimer 82.7, Tetramer 14.6, Pentamer 2.7.

Properties—Viscosity at 100° C.: 4.06 cSt; Viscosity at 40° C.: 17.4 cSt; Viscosity at −18° C.: n.d.; Viscosity at −40° C.: 2490 cSt; Pour point: <−65° C.; Flash point (ASTM D 92): 224° C.; NOACK volatility: 12.9%.

6 Centistoke poly-α-olefin oil:

Composition—Trimer 32.0, Tetramer 43.4, Pentamer 21.6, Hexamer 3.0.

Properties—Viscosity at 100° C.: 5.91 cSt; Viscosity at 40° C.: 31.4 cSt; Viscosity at −18° C.: n.d.; Viscosity at −40° C.: 7877 cSt; Pour point: −63° C.; Flash point (ASTM D 92): 235° C.; NOACK volatility: 7.5%.

75/25 Blend of 2 Centistoke and 4 Centistoke poly-α-olefin oils:

Composition—Monomer 0.3, Dimer 66.8, Trimer 27.3, Tetramer 4.8, Pentamer 0.8.

Properties—Viscosity at 100° C.: 2.19 cSt; Viscosity at 40° C.: 7.05 cSt; Viscosity at −18° C.: 84.4 cSt; Viscosity at −40° C.: 464 cSt; Pour point: <−65° C.; Flash point (ASTM D 92): 166° C.; NOACK volatility: 78.2%.

50/50 Blend of 2 Centistoke and 4 Centistoke poly-α-olefin oils:

Composition—Monomer 0.2, Dimer 44.7, Trimer 45.9, Tetramer 7.6, Pentamer 1.3, Hexamer 0.3.

Properties—Viscosity at 100° C.: 2.59 cSt; Viscosity at 40° C.: 9.36 cSt; Viscosity at −18° C.: 133 cSt; Viscosity at −40° C.: 792 cSt; Pour point: <−65° C.; Flash point (ASTM D 92): 168° C.; NOACK volatility: 57.4%.

25/75 Blend of 2 Centistoke and 4 Centistoke poly-α-olefin oils:

Composition—Monomer 0.1, Dimer 23.1, Trimer 62.7, Tetramer 11.5, Pentamer 2.1, Hexamer 0.5.

Properties—Viscosity at 100° C.: 3.23 cSt; Viscosity at 40° C.: 12.6 cSt; Viscosity at −18° C.: 214 cSt; Viscosity at −40° C.: 1410 cSt; Pour point: <−65° C.; Flash point (ASTM D 92): 190° C.: NOACK volatility: 30.8%.

95/05 Blend of 4 Centistoke and 6 Centistoke poly-α-olefin oils:

Composition—Dimer 0.5, Trimer 78.4, Tetramer 15.6, Pentamer 3.7. Hexamer 1.8.

Properties—Viscosity at 100° C.: 4.15 cSt; Viscosity at 40° C.: 17.9 cSt; Viscosity at −18° C.: n.d.; Viscosity at −40° C.: 2760 cSt; Pour point: <−65° C.; Flash point (ASTM D 92): 225° C.; NOACK volatility: 10.5%.

90/10 Blend of 4 Centistoke and 6 Centistoke poly-α-olefin oils:

Composition—Dimer 0.3, Trimer 76.0, Tetramer 17.0, Pentamer 4.7, Hexamer 2.0.

Properties—Viscosity at 100° C.: 4.23 cSt; Viscosity at 40° C.: 18.4 cSt; Viscosity at −18° C.: n.d.; Viscosity at −40° C.: 2980 cSt; Pour point: <−65° C.; Flash point (ASTM D 92): 228° C.; NOACK volatility: 11.4%.

80/20 Blend of 4 Centistoke and 6 Centistoke poly-α-olefin oils:

Composition—Dimer 0.3, Trimer 71.5, Tetramer 19.4, Pentamer 6.5, Hexamer 2.3.

Properties—Viscosity at 100° C.: 4.39 cSt; Viscosity at 40° C.: 19.9 cSt; Viscosity at −18° C.: n.d.; Viscosity at −40° C.: 3240 cSt; Pour point: <−65° C.; Flash point (ASTM D 92): 227° C.; NOACK volatility: 9.2%.

75/25 Blend of 4 Centistoke and 6 Centistoke poly-α-olefin oils:

Composition—Dimer 0.7, Trimer 69.0, Tetramer 21.0, Pentamer 7.3, Hexamer 2.0.

Properties—Viscosity at 100° C.: 4.39 cSt; Viscosity at 40° C.: 20.1 cSt; Viscosity at −18° C.: 436 cSt; Viscosity at −40° C.: 3380 cSt; Pour point: <−65° C.; Flash point (ASTM D 92): 226° C.; NOACK volatility: 14.2%.

50/50 Blend of 4 Centistoke and 6 Centistoke poly-α-olefin oils:

Composition—Dimer 0.4, Trimer 57.3, Tetramer 27.4, Pentamer 11.8, Hexamer 3.1.

Properties—Viscosity at 100° C.: 4.82 cSt; Viscosity at 40° C.: 23.0 cSt; Viscosity at −18° C.: 544 cSt; Viscosity at −40° C.: 4490 cSt; Pour point: <−65° C.; Flash point (ASTM D 92): 226° C.; NOACK volatility: 12.5%.

25/75 Blend of 4 Centistoke and 6 Centistoke poly-α-olefin oils:

Composition—Dimer 0.3, Trimer 45.3, Tetramer 33.4, Pentamer 16.4, Hexamer 4.6.

Properties—Viscosity at 100° C.: 5.38 cSt; Viscosity at 40° C.: 26.8 cSt; Viscosity at −18° C.: 690 cSt; Viscosity at −40° C.: 6020 cSt; Pour point: <−65° C.; Flash point (ASTM D 92): 250° C.; NOACK volatility: 9.2%.

Hydrogenated oligomers of this type contain little, if any, residual ethylenic unsaturation. Preferred oligomers are formed by use of a Friedel-Crafts catalyst (especially boron trifluoride promoted with water or a $C_{1-20}$ alkanol) followed by catalytic hydrogenation of the oligomer so formed using procedures such as are described in the foregoing U.S. patents.

Other catalyst systems which can be used to form oligomers of 1-alkene hydrocarbons, which, on hydrogenation, provide suitable oleaginous liquids include Ziegler catalysts such as ethyl aluminum sesquichloride with titanium tetrachloride, aluminum alkyl catalysts, chromium oxide catalysts on silica or alumina supports and a system in which a boron trifluoride catalyst oligomerization is followed by treatment with an organic peroxide.

Component b)

This component is an acrylic viscosity index improver which is supplied in the form of an solution in an inert solvent, typically a mineral oil solvent, which usually is a severely refined mineral oil. The viscosity index improver solution as received often will have a boiling point above 200° C., and a specific gravity of less that 1 at 25° C. In addition, it has sufficient shear stability such that the finished composition has a kinematic viscosity at 100° C. of at least 6.0 cSt after 4 hours in the Volkswagen taper roller bearing shear stability test, and a kinematic viscosity at 100° C. of at least 5.0 cSt after 20 hours in the Volkswagen taper roller bearing shear stability test. Preferably, the acrylic viscosity index improver has sufficient shear stability to enable the finished composition to possess a viscosity of at least 6.8 cSt at 100° C. after 40 cycles in the FISST (Fuel Injector Shear Stability Test) of ASTM D-5275, formerly known as the ASTM D-3945b method. On an active ingredient bases (i.e., excluding the weight of inert diluent or solvent associated with the viscosity index improver as supplied), the finished fluid compositions of this invention will normally contain in the range of about 2 to about 20 wt % of the polymeric viscosity index improver. Small departures from this range may be resorted to as necessary or desirable in any given situation.

Suitable proprietary materials for use as component b) are available from ROHM GmbH (Darmstadt, Germany) under the trade designations: VISCOPLEX® 5543, VISCOPLEX® 5548, VISCOPLEX® 5549, VISCOPLEX® 5550, VISCOPLEX® 5551 and VISCOPLEX® 5151, and from Rohm & Haas Company (Philadelphia, Pa.) under the trade designations ACRYLOID® 1277 and ACRYLOID® 1265E. Mixtures of the foregoing products can also be used. It is possible that other manufacturers may also have viscosity index improvers having the requisite performance properties required for use as component b). Details concerning the chemical composition and methods for the manufacture of such products are maintained as trade secrets by manufacturers of such products.

Preferably, the acrylic viscosity index will be provided as a hydrocarbon solution having a polymer content in the range of from about 50 to about 75 wt % and a nitrogen content in the range of about 0.15 to about 0.25 wt %. Such products preferably exhibit a permanent shear stability index (a PSSI value) using ASTM test method D-3945a of no higher than about 35, preferably 30 or less, and most preferably 15 or less.

Component c)

This component serves in a number of capacities. Besides being a minor but important component of the base oil itself, component c) functions as a seal swell agent and as a solubilizing/compatibilizing agent, and thus plays important roles in the compositions of this invention. As noted above, component c) is one or more oil-soluble dialkyl esters of a $C_4$ to $C_{14}$ (preferably $C_6$ to $C_{10}$) α,ω-dicarboxylic acid having a pour point of −45° C. or lower, and preferably a pour point of −55° C. or lower. Examples of such materials include diisodecyl glutarate, diisododecyl glutarate, diisooctyl adipate, di(2-ethylhexyl) adipate, diisononyl adipate, diisodecyl adipate, di(tridecyl) adipate, di(2-ethylhexyl) sebacate, diisooctyl sebacate, dioctyl azelate, diisooctyl azelate, di(2-ethylhexyl) azelate, diisooctyl dodecanediote, and mixtures thereof. Generally speaking, the most suitable diesters include the adipates, azelates, and sebacates of $C_8$–$C_{13}$ alkanols (or mixtures thereof). Mixtures of two or more different types of diesters (e.g., dialkyl adipates and dialkyl azelates, etc.) can also be used. Most preferred are the oil-soluble dialkyl esters of adipic acid having a pour point of −55° C. or lower.

As noted above, component c) is normally present at a concentration in the range of about 4 to about 25 wt % based on the total weight of the finished power transmission fluid composition. Generally speaking, the higher the molecular weight of the ester, the higher should be the treat rate within the foregoing range. Small departures from this range may be made whenever deemed necessary or desirable.

Component d)

The ashless dispersant can be of various types including succinimides, succinamides, succinic esters, succinic esteramides, Mannich products, long chain hydrocarbyl amines, polyol esters, or the like. Of these, the succinimides are preferred for use in the practice of this invention.

Method for the production of the foregoing types of ashless dispersants are known to those skilled in the art and are reported in the patent literature. For example, the synthesis of various ashless dispersants of the foregoing type is described in such patents as U.S. Pat. Nos. 2,459,112; 2,962,442, 2,984,550; 3,036,003; 3,163,603; 3,166,516; 3,172,892; 3,184,474; 3,202,678; 3,215,707; 3,216,936; 3,219,666; 3,236,770; 3,254,025; 3,271,310; 3,272,746; 3,275,554; 3,281,357; 3,306,908; 3,311,558; 3,316,177; 3,331,776; 3,340,281; 3,341,542; 3,346,493; 3,351,552; 3,355,270; 3,368,972; 3,381,022; 3,399,141; 3,413,347; 3,415,750; 3,433,744; 3,438,757; 3,442,808; 3,444,170; 3,448,047; 3,448,048; 3,448,049; 3,451,933; 3,454,497; 3,454,555; 3,454,607; 3,459,661; 3,461,172; 3,467,668; 3,493,520; 3,501,405; 3,522,179; 3,539,633; 3,541,012; 3,542,680; 3,543,678; 3,558,743; 3,565,804; 3,567,637; 3,574,101; 3,576,743; 3,586,629; 3,591,598; 3,600,372; 3,630,904; 3,632,510; 3,632,511; 3,634,515; 3,649,229; 3,697,428; 3,697,574; 3,703,536; 3,704,308; 3,725,277; 3,725,441; 3,725,480; 3,726,882; 3,736,357; 3,751,365; 3,756,953; 3,793,202; 3,798,165; 3,798,247; 3,803,039; 3,804,763; 3,836,471; 3,862,981; 3,936,480; 3,948,800; 3,950,341; 3,957,854; 3,957,855; 3,980,569; 3,991,098; 4,071,548; 4,173,540; 4,234,435; 5,137,980 and Re 26,433.

As used herein the term "ashless dispersant" means that the dispersant does not contain any metal constituent. As made clear above, the dispersant may contain boron, and preferably contains phosphorus, and most preferably contains both boron and phosphorus, elements which of course are not metals. Thus the term "ashless dispersant" encompasses dispersants which contain either or both of boron and phosphorus, even though such dispersant when thermally decomposed may leave some residues containing boron or phosphorus, or both.

The preferred ashless dispersants are one or more alkenyl succinimides of an amine having at least one primary amino group capable of forming an imide group. The alkenyl succinimides may be formed by conventional methods such as by heating an alkenyl succinic anhydride, acid, acid-ester, acid halide, or lower alkyl ester with an amine containing at least one primary amino group. The alkenyl succinic anhydride may be made readily by heating a mixture of polyolefin and maleic anhydride to about 180°–220° C. The polyolefin is preferably a polymer or copolymer of a lower monoolefin such as ethylene, propylene, isobutene and the like, having a number average molecular weight in the range of about 700 to about 2100 as determined by gel permeation chromatography (GPC). The more preferred source of alkenyl group is from polyisobutene having a GPC molecular weight in the range of about 800 to about 1800. In a still more preferred embodiment the alkenyl group is a polyisobutenyl group derived from polyisobutene having a GPC number average molecular weight of about 800–1350, and most preferably in the range of about 900–1100.

Mannich base dispersants are also a highly useful type of ashless dispersant for use in the practice of this invention.

Amines which may be employed in forming the ashless dispersant include any that have at least one primary amino group which can react to form an imide group and at least one additional primary or secondary amino group and/or at least one hydroxyl group. A few representative examples are: N-methyl-propanediamine, N-dodecylpropanediamine, N-aminopropyl-piperazine, ethanolamine, N-ethanolethylenediamine and the like.

Preferred amines are the alkylene polyamines, such as propylene diamine, dipropylene triamine, di-(1,2-butylene) triamino, and tetra-(1,2-propylene)pentamine.

The most preferred amines are the ethylene polyamines which can be depicted by the formula $$H_2N(CH_2CH_2NH)_nH$$

wherein n is an integer from one to about ten. These include: ethylene diamine, diethylene triamine, triethylene tetramine, tetraethylene pentamine, pentaethylene hexamine, and the like, including mixtures thereof in which case n is the average value of the mixture. These depicted ethylene polyamines have a primary amine group at each end so can form mono-alkenylsuccinimides and bis-alkenylsuccinimides. Commercially available ethylene polyamine mixtures usually contain minor amounts of branched species and cyclic species such as N-aminoethyl piperazine, N,N'-bis(aminoethyl)piperazine, N,N'-bis (piperazinyl)ethane, and like compounds. The preferred commercial mixtures have approximate overall compositions falling in the range corresponding to diethylene triamine to tetraethylene pentamine, mixtures generally corresponding in overall makeup to tetraethylene pentamine being most preferred.

Especially preferred ashless dispersants for use in the present invention are the products of reaction of a polyethylene polyamine, e.g. triethylene tetramine or tetraethylene pentamine, with a hydrocarbon substituted carboxylic acid or anhydride made by reaction of a polyolefin, preferably polyisobutene, of suitable molecular weight, with an unsaturated polycarboxylic acid or anhydride, e.g., maleic anhydride, maleic acid, fumaric acid, or the like, including mixtures of two or more such substances.

When the ashless dispersant contains phosphorus, it serves as a multipurpose component in that it an antiwear/extreme pressure agent as well as a dispersant. Accordingly, when a phosphorus-containing or boron- and phosphorus-containing dispersant is used it can supply all or a portion of the requisite phosphorus content of the finished fluid composition.

Methods suitable for introducing phosphorus or boron or a combination of phosphorus and boron into ashless dispersants are known and reported in the patent literature. One may refer, for example, to such U.S. Pat. Nos. as 3,087,936; 3,184,411; 3,185,645; 3,235,497; 3,254,025; 3,265,618; 3,281,428; 3,282,955; 3,284,410; 3,324,032; 3,338,832; 3,344,069; 3,403,102; 3,428,561; 3,502,677; 3,511,780; 3,513,093; 3,533,945; 3,623,985; 3,718,663; 3,865,740; 3,945,933; 3,950,341; 3,991,056; 4,093,614; 4,097,389; 4,428,849; 4,338,205; 4,428,849; 4,554,086; 4,615,826; 4,634,543; 4,648,980; 4,747,971, and 4,857,214. The procedures that are described in U.S. Pat. No. 4,857,214 are especially preferred for use in forming component e) of the compositions of this invention.

Accordingly, one preferred group of phosphorus- and/or boron-containing ashless dispersants comprises aliphatic hydrocarbyl-substituted succinimide of a mixture of cyclic and acyclic polyethylene polyamines having an approximate average overall composition falling in the range of from diethylene triamine through pentaethylene hexamine, said succinimide being heated with (1) at least one phosphorylating agent to form a phosphorus-containing succinimide ashless dispersant; or (2) at least one boronating agent to form a boron-containing succinimide ashless dispersant: or (3) either concurrently or in any sequence with at least one phosphorylating agent and at least one boronating agent to form a phosphorus- and boron-containing succinimide ashless dispersant. Particularly preferred ashless dispersants for use as component e) are aliphatic hydrocarbyl-substituted succinimides of the type described above which have been heated concurrently or in any sequence with a boron compound such as a boron acid, boron ester, boron oxide, or the like (preferably boric acid) and one or more inorganic phosphorus compounds such as an acid or anhydride (preferably phosphorous acid, $H_3PO_3$) or a partial or total sulfur analog thereof to form an oil-soluble product containing both boron and phosphorus. The use of the partial or total sulfur analogs is less preferred.

The amount of ashless dispersant on an "as received basis" (i.e., including the weight of impurities, diluents and solvents typically associated therewith) is generally within the range of about 1 to about 15 wt %, typically within the range of about 1 to about 10 wt %, preferably within the range of about 1 to about 6 wt %, and most preferably within the range of about 2 to about 5 wt %.

Component e)

The compositions of this invention contain one or more friction modifiers. These include such compounds as aliphatic amines or ethoxylated aliphatic amines, aliphatic fatty acid amides, aliphatic carboxylic acids, aliphatic carboxylic esters, aliphatic carboxylic ester-amides, aliphatic phosphonates, aliphatic phosphates, aliphatic thiophosphonates, aliphatic thiophosphates, etc., wherein the aliphatic group usually contains above about eight carbon atoms so as to render the compound suitably oil soluble. Also suitable are aliphatic substituted succinimides formed by reacting one or more aliphatic succinic acids or anhydrides with ammonia.

One preferred group of friction modifiers is comprised of the N-aliphatic hydrocarbyl-substituted diethanol amines in which the N-aliphatic hydrocarbyl-substituent is at least one straight chain aliphatic hydrocarbyl group free of acetylenic unsaturation and having in the range of about 14 to about 20 carbon atoms.

A particularly preferred friction modifier system is composed of a combination of at least one N-aliphatic hydrocarbyl-substituted diethanol amine and at least one N-aliphatic hydrocarbyl-substituted trimethylene diamine in which the N-aliphatic hydrocarbyl-substituent is at least one straight chain aliphatic hydrocarbyl group free of acetylenic unsaturation and having in the range of about 14 to about 20 carbon atoms. Further details concerning this friction modifier system are set forth in U.S. Pat. Nos. 5,372,735 and 5,441,656 (Ser. No. 08/236,524 filed May 2, 1994, both by Ohtani et al.).

Another particularly preferred friction modifier system is based on the combination of (i) at least one di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 10 to about 25 carbon atoms, and (ii) at least one hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms. For further details concerning this friction modifier system, reference should be had to U.S. Pat. No. 5,344,579.

Generally speaking, the compositions of this invention will contain up to about 1.25 wt %, and preferably from about 0.05 to about 1 wt % of one or more friction modifiers.

Component f)

This component will normally comprise a plurality of inhibitor components serving different functions. The inhibitors may be introduced in a preformed additive package which may contain in addition one or more other components used in the compositions of this invention. Alternatively these inhibitor components can be introduced individually or in various sub-combinations. While amounts can be varied within reasonable limits, the finished fluids of this invention will typically have a total inhibitor content in the range of about 0.2 to about 2 wt % and preferably about 0.5 to about 1 wt %, both on an "active ingredient"—i.e., excluding the weight of inert materials such as solvents or diluents that may be associated therewith.

Foam inhibitors form one type inhibitor suitable for use as inhibitor components in the compositions of this invention. These included silicones, polyacrylates, surfactants, and the like. One suitable acrylic defoamer material is PC-1244 (Monsanto Company).

Copper corrosion inhibitors constitute another class of additives suitable for inclusion in the compositions of this invention. Such compounds include thiazoles, triazoles and thiadiazoles. Examples of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles. The preferred compounds are the 1,3,4-thiadiazoles, a number of which are available as articles of commerce, and also combinations of triazoles such as tolyltriazole with a 1,3,5-thiadiazole such as a 2,5-bis(alkyldithio)-1,3,4-thiadiazole or 2-alkyldithio-5-mercapto-1,3,4-thiadiazole. Materials of these types that are available on the open market include Cobratec TT-100 and HiTEC® 4313 additive (Ethyl Petroleum Additives, Inc.). The 1,3,4-thiadiazoles are generally synthesized from hydrazine and carbon disulfide by known procedures. See, for example, U.S. Pat. Nos. 2,765,289; 2,749,311; 2,760,933; 2,850,453; 2,910,439; 3,663,561; 3,862,798; and 3,840,549.

Rust or corrosion inhibitors comprise another type of inhibitor additive for use in this invention. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like. Products of this type are currently available from various commercial sources, such as, for example, the dimer and trimer acids sold under the HYSTRENE trademark by the Humko Chemical Division of Witco Chemical Corporation and under the EMPOL trademark by Henkel Corporation. Another useful type of rust inhibitor for use in the practice of this invention is comprised of the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like. Materials of these types are available as articles of commerce. Mixtures of such rust or corrosion inhibitors can be used.

Oxidation inhibitors constitute still another group of inhibitors which are preferably included in the compositions of this invention. These materials are exemplified by the phenolic antioxidants, aromatic amine antioxidants, sulfurized phenolic antioxidants, and organic phosphates, among others. Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol), mixed methylene-bridged polyalkyl phenols, and 4,4'-thiobis(2-methyl-6-tert-butylphenol). N,N'-di-sec-butyl-p-phenylenediamine, 4-isopropylaminodiphenyl amine, phenyl-α-naphthyl amine, phenyl-β-naphthyl amine, and ring-alkylated diphenylamines serve as examples of aromatic amine antioxidants. Most preferred are the sterically hindered tertiary butylated phenols, the ring alkylated diphenylamines and combinations thereof.

The amounts of the inhibitor components used will depend to some extent upon the composition of the component and its effectiveness when used in the finished composition. However, generally speaking, the finished fluid will typically contain the following concentrations (weight percent) of the inhibitor components (active ingredient basis):

| Inhibitor | Typical Range | Preferred Range |
|---|---|---|
| Foam inhibitor | 0 to 0.1 | 0.01 to 0.08 |
| Copper corrosion inhibitor | 0 to 1.5 | 0.01 to 1 |
| Rust inhibitor | 0 to 0.5 | 0.01 to 0.3 |
| Oxidation inhibitor | 0 to 1 | 0.01 to 0.6 |

Other Components

Very small amounts of certain metal-containing detergents such as calcium sulfurized phenates and calcium alkylbenzene sulfonate can also be used. However, as noted above, if an oil-soluble phenate or sulfonate is used it should be proportioned such that the finished fluid contains no more than about 100 ppm of metal, and preferably no more than about 50 ppm of metal. The sulfurized phenates are preferably neutral salts containing a stoichiometric amount of calcium, and in any event should have a total base number (TBN) of not more than about 200 mg KOH/gram.

In another preferred embodiment, the finished fluid will contain only two sulfur-containing additive components, namely, (i) one or more oil-soluble calcium sulfurized alkylphenates and (ii) one or more oil-soluble 1,3,5-thiadiazole copper corrosion inhibitors such as a 2,5-bis(alkyldithio)-1,3,5-thiadiazole. In other words, these preferred compositions are devoid of conventional sulfur-containing antiwear additives such as sulfurized olefins (sulfurized isobutylene, etc), dihydrocarbyl polysulfides, sulfurized fatty acids, and sulfurized fatty acid esters.

When the phosphorus content of the finished fluid is not completely supplied by use of a phosphorus-containing ashless dispersant (or a boron- and phosphorus-containing ashless dispersant), the remainder of the phosphorus content is preferably supplied by inclusion in the composition of one or more phosphorus-containing esters or acid-esters such as oil-soluble organic phosphites, oil-soluble organic acid phosphites, oil-soluble organic phosphates, oil-soluble organic acid phosphates, oil-soluble phosphoramidates, and oil-soluble phosphetanes. Examples include trihydrocarbyl phosphates, trihydrocarbyl phosphites, dihydrocarbyl phosphates, dihydrocarbyl phosphonates or dihydrocarbyl phosphites or mixtures thereof, monohydrocarbyl phosphates, monohydrocarbyl phosphites, and mixtures of any two or more of the foregoing. Oil-soluble amine salts of organic acid phosphates are a preferred category of auxiliary phosphorus-containing additives for use in the fluids of this invention. Sulfur-containing analogs of any of the foregoing compounds can also be used, but are less preferred. Most preferred as a commercially-available auxiliary phosphorus additive is an amine phosphate antiwear/extreme pressure agent available from Ciba-Geigy Corporation as Irgalube 349.

Thus, in one of its embodiments, this invention provides compositions which contain a phosphorus-containing ashless dispersant such as a succinimide, a boron-containing ashless dispersant such as a succinimide, and/or a phosphorus- and boron-containing ashless dispersant such as a succinimide, together with at least one phosphorus-containing substance selected from (1) one or more inorganic acids of phosphorus; or (2) one or more inorganic thioacids of phosphorus; or (3) one or more monohydrocarbyl esters of one or more inorganic acids of phosphorus; or (4) one or more monohydrocarbyl esters of one or more inorganic thioacids of phosphorus; or (5) any combination of any two, or any three or all four of (1), (2), (3), and (4); or at least one oil-soluble amine salt or complex or adduct of any of (1), (2), (3), (4), and (5), said amine optionally being in whole or in part an amine moiety in (i) a basic nitrogen-containing ashless dispersant such as a succinimide or (ii) a boron- and basic nitrogen-containing ashless dispersant such as a succinimide or (iii) a phosphorus- and basic nitrogen-containing ashless dispersant such as a succinimide or (iv) a phosphorus-, boron- and basic nitrogen-containing ashless dispersant such as a succinimide.

The boron content of the compositions of this invention is preferably supplied by use of a boron-containing ashless dispersant or a boron- and phosphorus-containing ashless dispersant). When the boron content of the finished fluid is not completely supplied in this manner, the remainder of the boron content is preferably supplied by inclusion in the composition of one or more oil-soluble boron esters such as a glycol borate or glycol biborate.

Although not necessary, supplemental seal swell agents may be used. These include sulfone materials such as described in U.S. Pat. Nos. 3,974,081 and 4,029,587. Lubrizol 730 additive (The Lubrizol Corporation) is understood to be a commercially-available sulfone type seal swell agent. The phthalates of $C_4$–$C_{13}$ alkanols (or mixtures thereof) are also potential supplemental seal swell additives. Other materials that may be considered for use include polyol esters such as Emery 2935, 2936, and 2939 esters from the Emery Group of Henkel Corporation and Hatcol 2352, 2962, 2925, 2938, 2939, 2970, 3178, and 4322 polyol esters from Hatco Corporation.

Dyes, pour point depressants, air release agents, and the like can also be included in the compositions of this invention.

In selecting any of the foregoing additives, it is important to ensure that each selected component is soluble in the fluid composition, is compatible with the other components of the composition, and does not interfere significantly with the requisite viscosity or shear stability properties of the overall finished fluid composition.

The individual components employed can be separately blended into the base fluid or can be blended therein in various subcombinations, if desired. Ordinarily, the particular sequence of such blending steps is not critical. Moreover, such components can be blended in the form of separate solutions in a diluent. It is preferable, however, to blend the additive components used in the form of an additive concentrate, as this simplifies the blending operations, reduces the likelihood of blending errors, and takes advantage of the compatibility and solubility characteristics afforded by the overall concentrate.

Additive concentrates can thus be formulated to contain all of the additive components and if desired, some of the base oil component a) and/or c), in amounts proportioned to yield finished fluid blends consistent with the concentrations described above. In most cases, the additive concentrate will contain one or more diluents such as light mineral oils, to facilitate handling and blending of the concentrate. Thus concentrates containing up to about 50% by weight of one or more diluents or solvents can be used, provided the solvents are not present in amounts that interfere with the low and high temperature and flash point characteristics and the performance of the finished power transmission fluid composition. In this connection, the additive components utilized pursuant to this invention should be selected and proportioned such that an additive concentrate or package formulated from such components will have a flash point of 170° C. or above, and preferably a flash point of at least 180° C., using the ASTM D-92 test procedure.

It is deemed possible, but not desirable, to utilize blends of components a) and b) with one or more other base oils having suitable viscosities, provided that the resultant blend contains a major proportion of the combination of components a), b), and c), and in addition possesses the requisite compatibility, viscosity properties, shear stability, and performance criteria (e.g., friction retention and durability, wear resistance, oxidation resistance and seal compatibility) for use in accordance with this invention.

Illustrative of such potentially useable auxiliary base oils and fluids of lubricating viscosity are hydrotreated mineral oils preferably in the range of about 55N to about 100N, and more preferably in the range of about 60N to about 80N, and most preferably the hydrotreated oils should be substantially wax-free. Likewise certain dewaxed highly paraffinic mineral oils having the requisite viscosity parameters and produced by processing other than hydrotreatment may be used in small amounts as auxiliary base oils. Synthetic esters such as mixed $C_9$ and $C_{11}$ dialkylphthalates (e.g., ICI Emkarate 911P ester oil), trimethylol propane trioleate, di-(isotridecyl) adipate (e.g., BASF Glissofluid A13), pentaerythritol tetraheptanoate and equivalent synthetic base oils may be found suitable. However in all cases the overall base oil must contain at least about 70 wt % (and most preferably at least about 75 wt %) of component a).

The practice and advantages of this invention are illustrated by the following illustrative examples in which all values are percentages by weight on an "as received basis". In these Examples Component a) is composed of mixtures made from at least two of DURASYN 162 ("2 cSt");

DURASYN 164 ("4 cSt"); and DURASYN 166 ("6 cSt") poly-α-olefin oils (Albemarle Corporation) proportioned such that the mixture of the selected oils has a kinematic viscosity in the range of 2 to 6 cSt at 100° C. Component b) is either Viscoplex 5549 ("5549") or Viscoplex 5151 ("5151"). Component c) is diisooctyl adipate ("DIOA") which has a nominal pour point of approximately −68° C., Component d) is a boronated and phosphorylated pre-blend composition prepared substantially as described in Example 1A of U.S. Pat. No. 4,857,214, and the Silicone fluid is a 4% solution of poly(dimethylsiloxane) in light oil.

EXAMPLES 1–10

Automatic transmission fluids are formed by blending together the components in the proportions as specified in Tables 1 and 2.

TABLE 1

| Components | Ex. 1 | Ex. 2 | Ex. 3 | Ex. 4 | Ex. 5 |
|---|---|---|---|---|---|
| Component a) - 2 cSt | 5.00 | 5.00 | — | 3.00 | 2.00 |
| Component a) - 4 cSt | 25.68 | 25.68 | 31.18 | 25.68 | 28.68 |
| Component a) - 6 cSt | 44.96 | 44.73 | 44.96 | 44.96 | 44.91 |
| Component b) - 5549 | 5.50 | 5.50 | 5.00 | 5.50 | 5.50 |
| Component b) - 5151 | — | — | — | — | — |
| Component c) - DIOA | 14.00 | 14.00 | 14.00 | 16.00 | 14.00 |
| Component d) | 3.77 | 4.00 | 3.77 | 3.77 | 3.77 |
| Ethomeen T-12 | 0.10 | 0.10 | 0.12 | 0.10 | 0.12 |
| Unamine O | — | — | — | — | 0.01 |
| Naugalube 438L | 0.30 | 0.26 | 0.26 | 0.30 | 0.30 |
| HiTEC® 4735 | 0.20 | 0.20 | 0.20 | 0.20 | 0.20 |
| HiTEC® 314 | 0.04 | 0.04 | 0.04 | 0.04 | 0.04 |
| PC-1244 | 0.03 | 0.03 | 0.03 | 0.03 | 0.03 |
| Silicone fluid | 0.02 | 0.02 | 0.02 | 0.02 | 0.02 |
| OLOA 216C | 0.05 | 0.04 | 0.05 | 0.05 | 0.05 |
| Mazawet 77 | 0.05 | 0.04 | 0.05 | 0.05 | 0.05 |
| Tomah PA14 | 0.05 | 0.05 | 0.05 | 0.05 | 0.05 |
| Octanoic acid | 0.05 | 0.05 | 0.05 | 0.05 | 0.05 |
| Red Dye | 0.02 | 0.02 | 0.02 | 0.02 | 0.02 |
| Diluent oil - 45N | 0.18 | 0.24 | 0.20 | 0.18 | 0.20 |

TABLE 2

| Components | Ex. 6 | Ex. 7 | Ex. 8 | Ex. 9 | Ex. 10 |
|---|---|---|---|---|---|
| Component a) - 2 cSt | — | 3.00 | 3.00 | — | — |
| Component a) - 4 cSt | 31.18 | 25.00 | 25.00 | 29.00 | 29.00 |
| Component a) - 6 cSt | 44.96 | 43.96 | 43.91 | 43.96 | 43.505 |
| Component b) - 5549 | 5.00 | — | — | — | — |
| Component b) - 5151 | — | 8.18 | 8.18 | 7.18 | 7.18 |
| Component c) - DIOA | 14.00 | 15.00 | 15.00 | 15.00 | 15.00 |
| Component d) | 3.77 | 3.77 | 3.77 | 3.77 | 4.00 |
| Ethomeen T-12 | 0.10 | 0.12 | 0.12 | 0.12 | 0.10 |
| Duomeen O | 0.005 | — | — | — | 0.005 |
| Unamine O | 0.01 | — | 0.01 | — | 0.01 |
| Naugalube 438L | 0.26 | 0.26 | 0.26 | 0.26 | 0.30 |
| HiTEC® 4735 | 0.20 | 0.20 | 0.20 | 0.20 | 0.25 |
| HiTEC® 314 | 0.04 | 0.04 | 0.04 | 0.04 | 0.05 |
| Irgalube 349 | — | — | 0.04 | — | 0.05 |
| PC-1244 | 0.03 | 0.03 | 0.03 | 0.03 | 0.02 |
| Silicone fluid | 0.02 | 0.02 | 0.02 | 0.02 | 0.02 |
| OLOA 216C | 0.04 | 0.05 | 0.04 | 0.05 | 0.04 |
| Mazawet 77 | 0.05 | 0.05 | 0.04 | 0.05 | 0.05 |
| Tomah PA14 | 0.05 | 0.05 | 0.05 | 0.05 | 0.05 |
| Octanoic acid | 0.05 | 0.05 | 0.05 | 0.05 | 0.05 |
| Red Dye | 0.02 | 0.02 | 0.02 | 0.02 | 0.02 |
| Diluent oil - 45N | 0.215 | 0.20 | 0.22 | 0.20 | 0.30 |

Although each of the above compositions has not been evaluated, all experimental results obtained to date indicate that the compositions of the foregoing examples will posses (i) a kinematic viscosity of at least 6.8 cSt at 100° C., (ii) a Brookfield viscosity of 15,000 cP or less at −40° C., (iii) a kinematic viscosity at 100° C. of at least 6.0 cSt after 4 hours in the Volkswagen taper roller bearing shear stability test, and (iv) a kinematic viscosity at 100° C. of at least 5.0 cSt after 20 hours in the Volkswagen taper roller bearing shear stability test. In addition, evaluations to date indicate that the compositions posses an excellent combination of performance properties deemed necessary to satisfy the requirements for a premium grade automatic transmission fluid.

Figure 2:
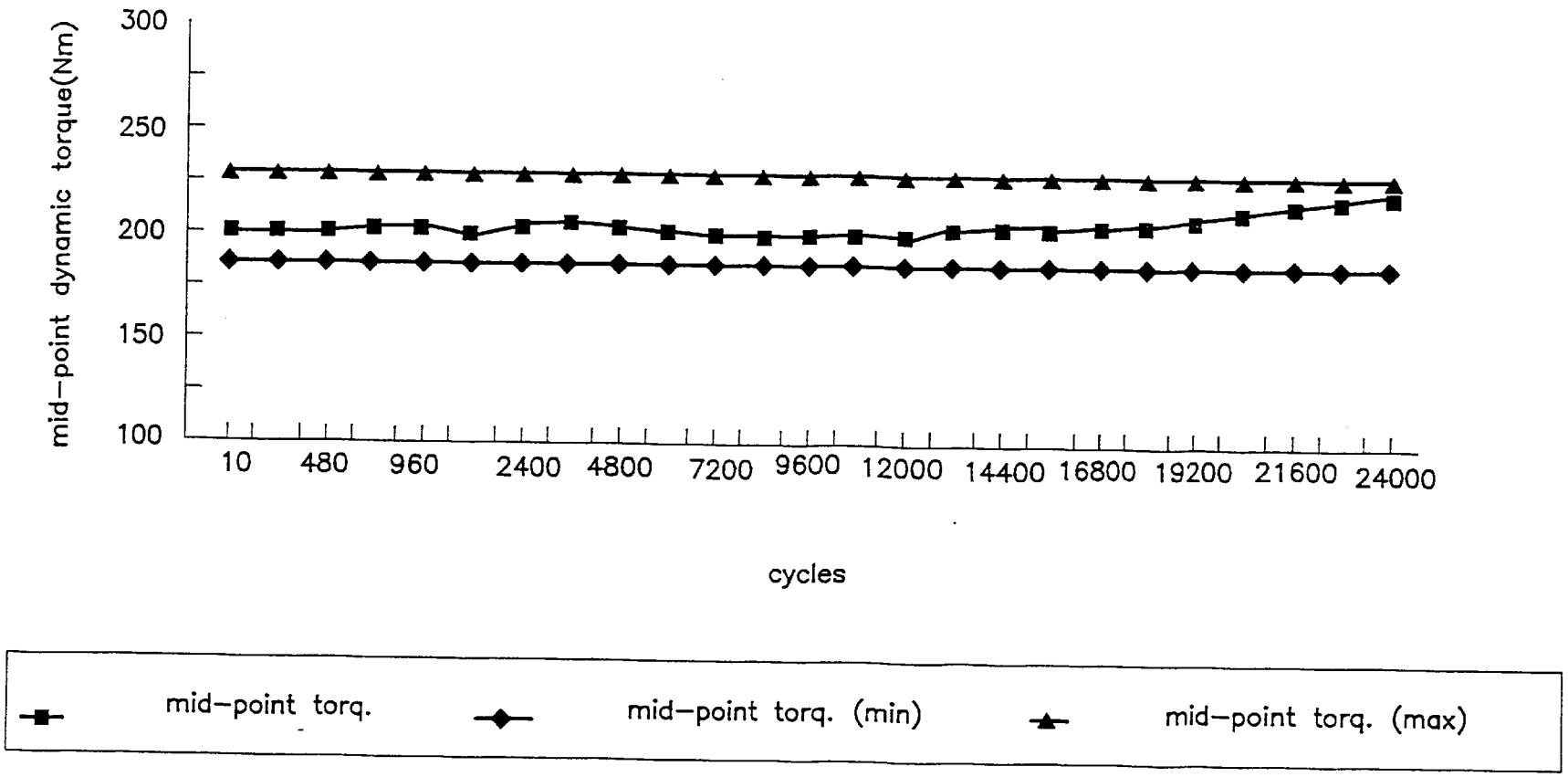
Figure 3:
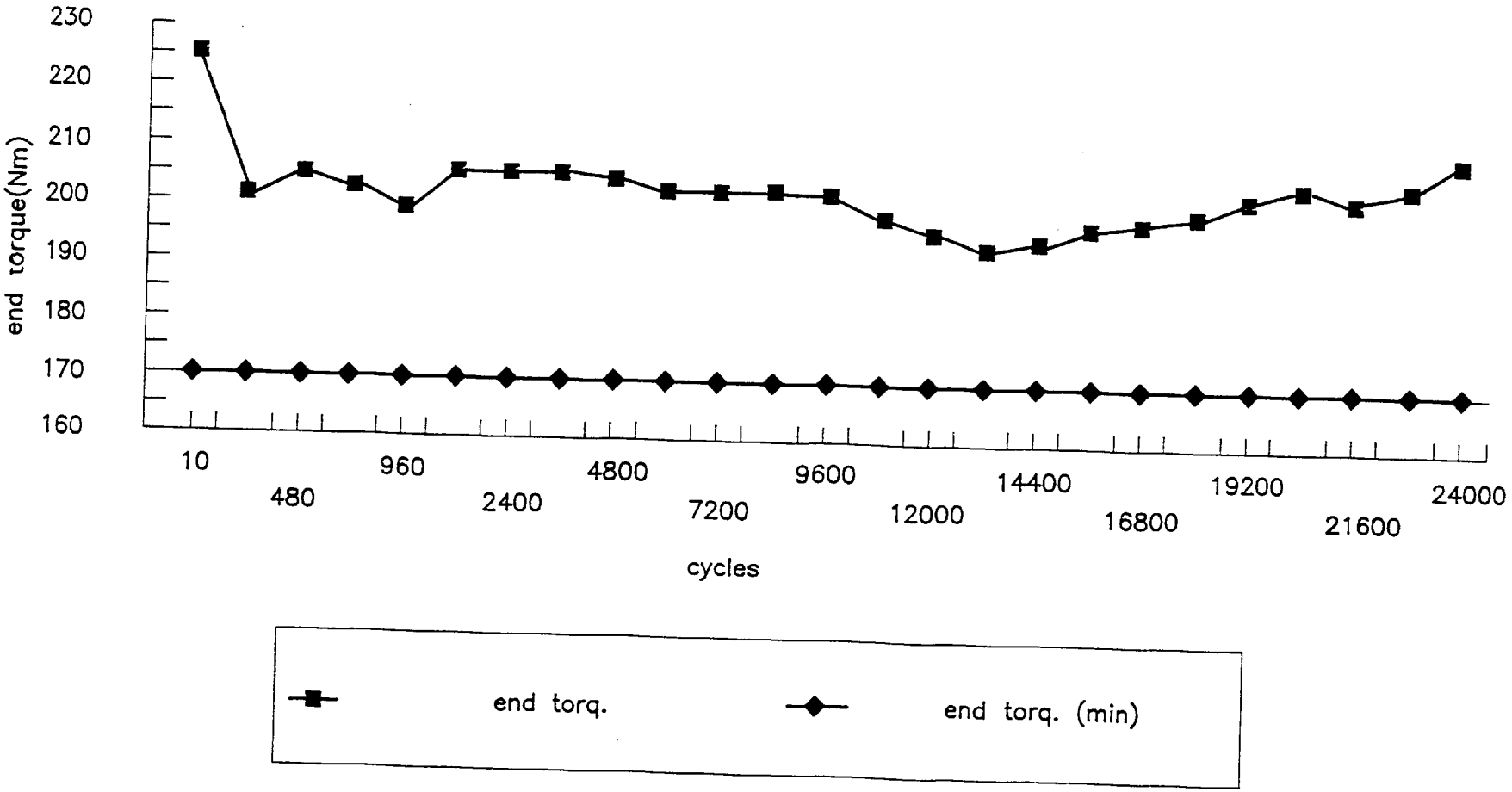
Figure 4:
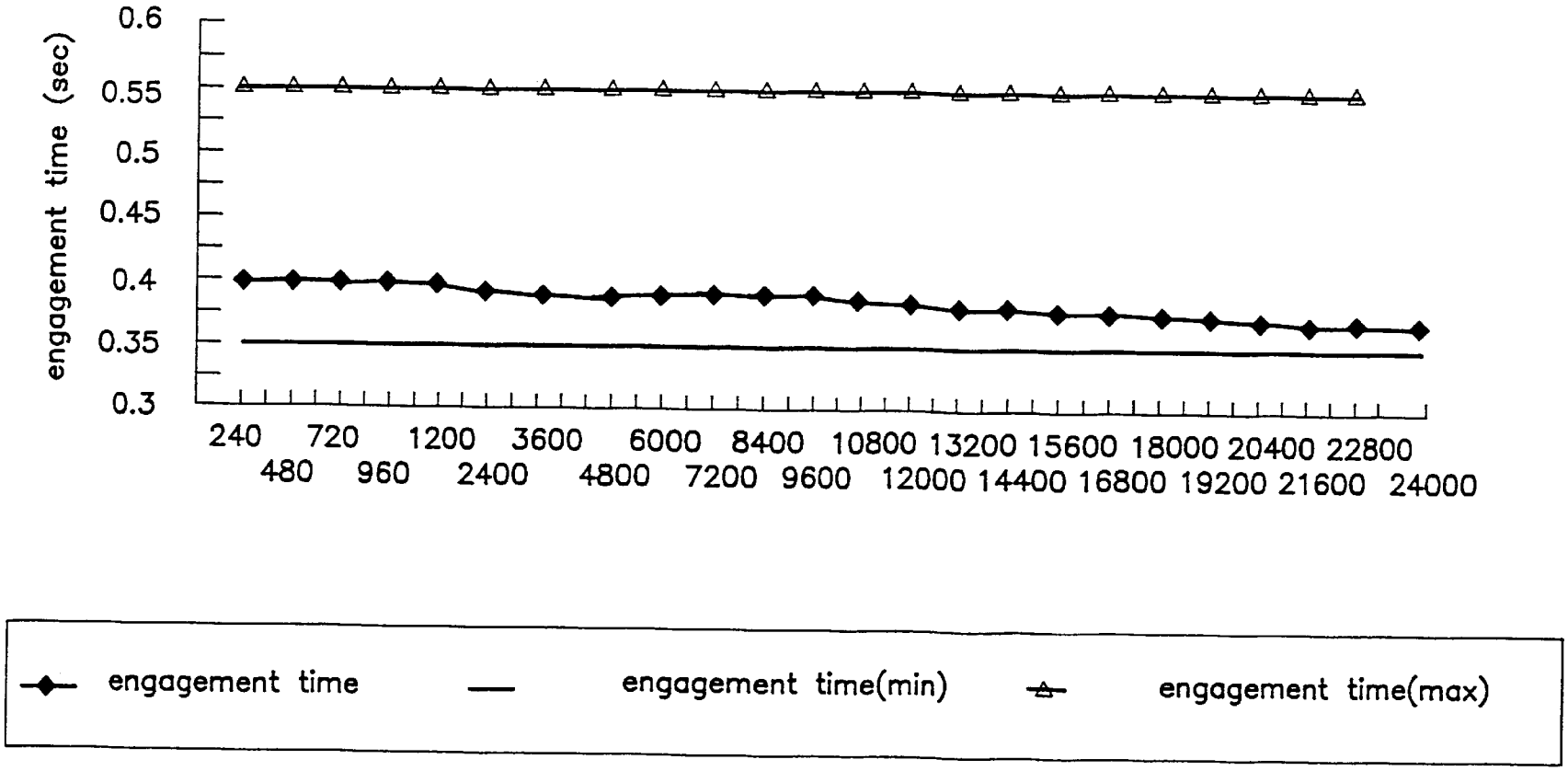
Figure 5:
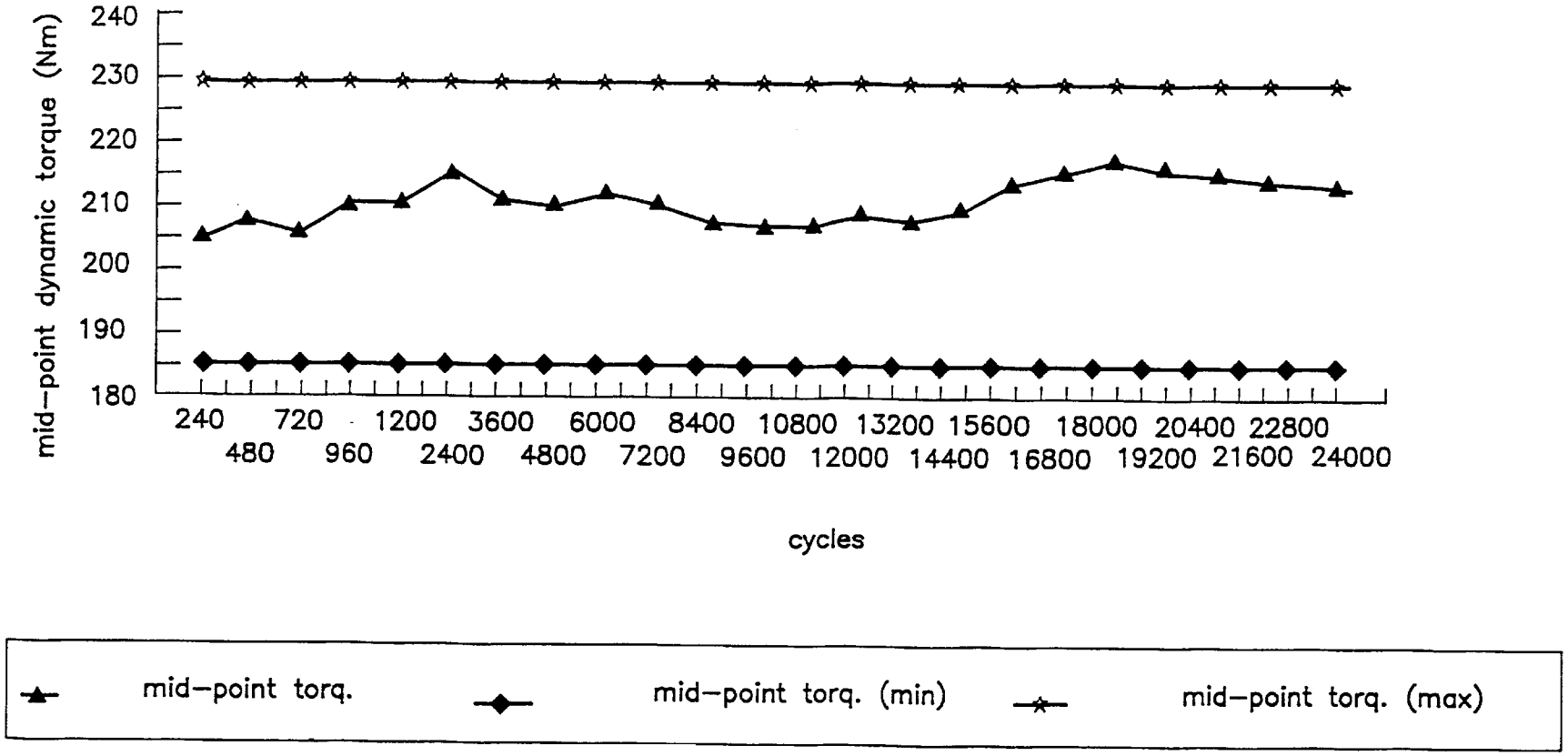
Figure 6:
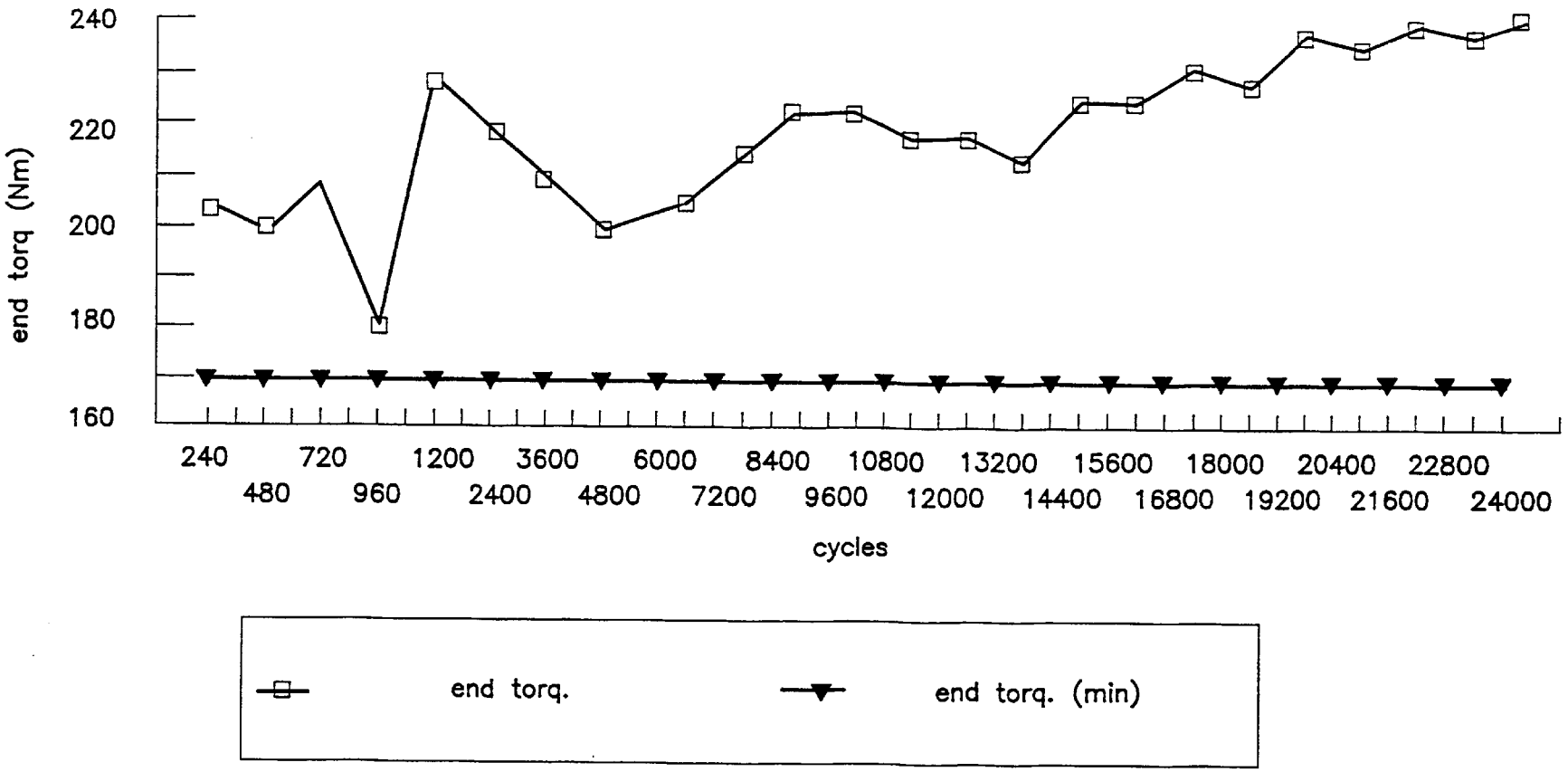

For example, FIGS. 1–3 are plots of friction properties of a an ATF of this invention as determined by use of the Standard 3T40 Band Friction Test of General Motors Corporation. FIG. 1 shows the engagement times in seconds as measured throughout the test. It will be seen that not only did these engagement times remain within the prescribed specification limits of 0.35 second minimum and 0.55 second maximum, but in addition the values were on the low side of this range. This is very desirable as it translates into higher mid-point dynamic torque as is shown by the results plotted in FIG. 2 which remained within the prescribed specification limits of 185 to 230 Newton-meters (Nm). The end torque values also expressed in Newton-meters shown in FIG. 3 likewise are very desirable as they remained well above the prescribed minimum specification value of 170 Nm throughout the test. The corresponding results shown in FIGS. 4–6 obtained with another fluid of this invention show the same excellent friction performance in the same test procedure.

(le;.5q)The excellent seal compatibility performance made possible from the practice of this invention is illustrated by the data set forth in Tables 3–6. Tables 3 and 4 show the performance of two fluids of this invention in the current Dexron® III test procedure. Their performance in the Mercon® test procedure is shown in Tables 5 and 6. In all cases passing results were achieved.

TABLE 3

| Seal Material | Property | Results | Test Limits |
|---|---|---|---|
| Polyacrylic (A) | Volume, % | +6.32 (Pass) | +5 to +12 |
| | Hardness, Pts | −1 (Pass) | −8 to +1 |
| Nitrile (B) | Volume, % | +2.15 (Pass) | +1 to +6 |
| | Hardness, Pts | +1 (Pass) | −3 to +6 |
| Polyacrylic (C) | Volume, % | +4.14 (Pass) | +2 to +7 |
| | Hardness, Pts | 0 (Pass) | −4 to +4 |
| Fluoroelastomer (H) | Volume, % | +27.43 (Pass) | +0.5 to +5 |
| | Hardness, Pts | −2 (Pass) | −5 to +6 |
| Silicone (J) | Volume, % | +27.43 (Pass) | +23 to +45 |
| | Hardness, Pts | −18 (Pass) | −30 to −13 |
| Ethylene-acrylic (R) | Volume, % | +14.95 (Pass) | +13 to +27 |
| | Hardness, Pts | −11 (Pass) | −17 to −7 |

TABLE 4

| Seal Material | Property | Results | Test Limits |
|---|---|---|---|
| Polyacrylic (A) | Volume, % | +6.74 (Pass) | +5 to +12 |
| | Hardness, Pts | −3 (Pass) | −8 to +1 |
| Nitrile (B) | Volume, % | +1.38 (Pass) | +1 to +6 |
| | Hardness, Pts | 0 (Pass) | −3 to +6 |
| Polyacrylic (C) | Volume, % | +4.71 (Pass) | +2 to +7 |
| | Hardness, Pts | −1 (Pass) | −4 to +4 |
| Fluoroelastomer (H) | Volume, % | +3.68 (Pass) | +0.5 to +5 |
| | Hardness, Pts | −3 (Pass) | −5 to +6 |
| Silicone (J) | Volume, % | +24.2 (Pass) | +23 to +45 |
| | Hardness, Pts | −16 (Pass) | −30 to −13 |
| Ethylene-acrylic (R) | Volume, % | +14.4 (Pass) | +13 to +27 |
| | Hardness, Pts | −9 (Pass) | −17 to −7 |

TABLE 5

| Seal Material | Property | Results | Test Limits |
|---|---|---|---|
| ATRR-100 | Volume, % | +2.94 (Pass) | +1 to +6 |
| (Nitrile) | Hardness, Pts | +3 (Pass) | −5 to +5 |
| ATRR-200 | Volume, % | +5.35 (Pass) | +3 to +8 |
| (Polyacrylate) | Hardness, Pts | +2 (Pass) | −5 to +5 |
| ATRR-300 | Reversion | No Reversion | No Reversion |
| (Silicone) | | | |
| ATRR-400 | Volume, % | +3.28 | No Limits |
| (Fluoroelastomer) | Hardness, Pts | 0 | Report Only |
| ATRR-500 (Ethyl- | Volume, % | +11.15 | No Limits |
| ene-acrylic) | Hardness, Pts | −4 | Report Only |

TABLE 6

| Seal Material | Property | Results | Test Limits |
|---|---|---|---|
| ATRR-100 | Volume, % | +2.36 (Pass) | +1 to +6 |
| (Nitrile) | Hardness, Pts | 0 (Pass) | −5 to +5 |
| ATRR-200 | Volume, % | +5.60 (Pass) | +3 to +8 |
| (Polyacrylate) | Hardness, Pts | −2 (Pass) | −5 to +5 |
| ATRR-300 | Reversion | No Reversion | No Reversion |
| (Silicone) | | | |
| ATRR-400 | Volume, % | +2.86 | No Limits |
| (Fluoroelastomer) | Hardness, Pts | 0 | Report Only |
| ATRR-500 (Ethyl- | Volume, % | +9.93 | No Limits |
| ene-acrylic) | Hardness, Pts | −5 | Report Only |

Table 7 summarizes the excellent shear stability of a fluid of this invention when subjected to three different test procedures. The fluid subjected to these tests had a kinomatic viscosity at 100° C. of 7.49 and a Brookfield viscosity of 5640 at −40° C. The results shown in Table 7 are kinematic viscosities at 100° C. The Taper Roller Bearing Shear Test results met the Mercedes-Benz requirements of 0.6 cSt after 4 hours and 5.0 cSt after 20 hours of shearing.

TABLE 7

| Test Procedure | Results | % Shear |
|---|---|---|
| FZG Shear Test, 20 h, cSt | 6.36 | 15.1 |
| ASTM D-3945b (FISST), 20 cycles, cSt | 6.68 | 10.8 |
| Taper Roller Bearing Shear Test, 4 h, cSt | 6.40 | 14.6 |
| Taper Roller Bearing Shear Test, 8 h, cSt | 6.03 | 19.5 |
| Taper Roller Bearing Shear Test, 20 h, cSt | 5.67 | 24.3 |

As used herein the term "oil-soluble" means that the substance under discussion should be sufficiently soluble at 20° C. in the particular power transmission fluid composition being formulated pursuant to this invention base oil to reach at least the minimum concentration required to enable the substance to serve its intended function. Preferably the substance will have a substantially greater solubility in the fluid composition than this. However, the substance need not dissolve in the fluid composition in all proportions.

Each and every U.S. patent document referred to hereinabove is incorporated herein by reference as if fully set forth herein.

It will be readily apparent that this invention is susceptible to considerable modification in its practice. Accordingly, this invention is not intended to be limited by the specific exemplifications presented hereinabove. Rather, what is intended to be covered is within the spirit and scope of the appended claims.

We claim:

1. A power transmission fluid composition wherein said composition has on a weight bases an oil-soluble boron content of about 0.001 to about 0.1%, an oil-soluble phosphorus content of about 0.005 to about 0.2%, and either no metal additive content or an oil-soluble metal content as one or more metal-containing additives of no more than about 100 ppm; wherein said composition comprises the following components:

a) at least about 70 wt % based on the total weight of said composition of one or more hydrogenated poly-α-olefin oligomer fluids, this component a) having a viscosity in the range of about 2 to about 6 cSt at 100° C.;

b) on an active ingredient basis, about 2 to about 20 wt % based on the total weight of said composition of an acrylic viscosity index improver in the form of a solution in an inert solvent;

c) about 4 to about 25 wt % based on the total weight of said composition of at least one oil-soluble dialkyl ester of a $C_4$ to $C_{14}$ α,ω-dicarboxylic acid having a pour point of −45° C. or lower d) a dispersant amount of at least one oil-soluble ashless dispersant;

e) a friction modifying amount of at least one oil-soluble friction modifier; and f) oil-soluble inhibitors selected from the group consisting of foam inhibitors, copper corrosion inhibitors, rust inhibitors, and oxidation inhibitors;

with the proviso that said power transmission fluid composition has (i) a kinematic viscosity of at least 6.8 cSt at 100° C., (ii) a Brookfield viscosity of 15,000 cP or less at −40° C., (iii) a kinematic viscosity at 100° C. of at least 6.0 cSt after 4 hours in the Volkswagen taper roller bearing shear stability test, and (iv) a kinematic viscosity at 100° C. of at least 5.0 cSt after 20 hours in the Volkswagen taper roller bearing shear stability test.

2. A composition in accordance with claim 1 wherein said composition is devoid of any sulfurized ester and is devoid of any sulfurized olefinic compound.

3. A composition in accordance with claim 1 wherein said ashless dispersant is a phosphorus-containing dispersant.

4. A composition in accordance with claim 1 wherein said ashless dispersant is a phosphorus-containing dispersant, wherein said composition contains a non-dispersant metal-free oil-soluble nitrogen- and phosphorus-containing antiwear/extreme pressure agent, and wherein said phosphorus content is provided by said phosphorus-containing dispersant and said antiwear/extreme pressure agent.

5. A composition in accordance with claim 1 wherein said ashless dispersant is a boron- and phosphorus-containing dispersant.

6. A composition in accordance with claim 1 wherein said ashless dispersant is a boron- and phosphorus-containing succinimide dispersant.

7. A composition in accordance with claim 6 wherein said boron- and phosphorus-containing succinimide dispersant is formed by a process which comprises heating a succinimide ashless dispersant concurrently or in any sequence with one or more inorganic phosphorus compounds and with one or more boron compounds to a temperature at which an essentially solids-free composition is formed.

8. A composition in accordance with claim 6 wherein said boron- and phosphorus-containing succinimide dispersant is formed by a process which comprises heating an alkenyl succinimide dispersant in which the alkenyl group is derived from a polyolefin having a GPC number average molecular weight in the range of about 700 to about 2100 concurrently or in any sequence with one or more inorganic phosphorus compounds and with one or more boron compounds to a temperature at which an essentially solids-free composition is formed.

9. A composition in accordance with claim 6 wherein said boron- and phosphorus-containing succinimide dispersant is formed by a process which comprises heating a polyisobutenyl succinimide dispersant in which the alkenyl group is derived from polyisobutene having a GPC number average molecular weight in the range of about 800 to about 1350 concurrently or in any sequence with one or more inorganic phosphorus compounds and with one or more boron compounds to a temperature at which an essentially solids-free composition is formed.

10. A composition in accordance with claim 1 wherein said boron- and phosphorus-containing succinimide dispersant is formed by a process which comprises heating a polyisobutenyl succinimide dispersant in which the isobutenyl group is derived from polyisobutene having a GPC number average molecular weight in the range of about 900 to about 1100 concurrently or in any sequence with phosphorous acid, $H_3PO_3$, and with boric acid in the presence of water to a temperature at which an essentially solids-free composition is formed and stripping off water from said essentially solids-free composition.

11. A composition in accordance with claim 1 wherein said inhibitors include (i) in the range of about 0.1 to about 1.0 wt % of at least one 1,3,5-thiadiazole copper corrosion inhibitor and (ii) in the range of about 0.01 to about 0.1 wt % of calcium sulfurized alkylphenate, the foregoing components (i) and (ii) being the only sulfur-containing additive components in said composition.

12. A composition in accordance with claim 1 wherein said component c) is at least one dialkyl ester of adipic acid.

13. A composition in accordance with claim 12 wherein said dialkyl ester consists essentially of diisooctyl adipate.

14. A composition in accordance with claim 1 wherein said composition is devoid of any sulfurized enter and is devoid of any sulfurized olefinic compound, wherein said ashless dispersant is a boron- and phosphorus-containing dispersant, and wherein said inhibitors include (i) in the range of about 0.1 to about 1.0 wt % of at least one 1,3,5-thiadiazole copper corrosion inhibitor and (ii) in the range of about 0.01 to about 0.1 wt % of calcium sulfurized alkylphenate.

15. A composition in accordance with claim 14 wherein said component c) is at least one dialkyl ester of adipic acid.

16. A composition in accordance with claim 1 wherein the hydrogenated poly-α-olefin oligomer fluid used informing said composition consists essentially of a mixture of a poly-α-olefin lubricating fluid with a viscosity of about 4 cSt at 100° C. and a poly-α-olefin lubricating fluid with a viscosity of about 6 cSt at 100° C.

17. A composition in accordance with claim 1 wherein said ashless dispersant is a boron- and phosphorus-containing dispersant, wherein at least all of said boron content is provided by said boron- and phosphorus-containing dispersant, and wherein said inhibitors include (i) in the range of about 0.1 to about 1.0 wt % of at least one thiadiazole copper corrosion inhibitor, and (ii) in the range of about 0.01 to about 0.1 wt % of calcium sulfurized alkylphenate, and wherein the foregoing components (i) and (ii) are the only sulfur-containing additive components in said composition.

18. A composition in accordance with claim 1 wherein said ashless dispersant is a boron- and phosphorus-containing dispersant, wherein said inhibitors include at least one foam inhibitor, at least one copper corrosion inhibitor, at least one rust inhibitor, and at least one oxidation inhibitor.

19. A composition in accordance with claim 1 wherein said composition is devoid of any poly-α-olefin lubricating fluid with contains more than a minor amount by weight of species above hexamer, wherein said ashless dispersant is a boron- and phosphorus-containing dispersant, and wherein said oil-soluble inhibitors include (i) at least one 2-mercapto-5-alkyldithio-1,3,5-thiadiazole or 2,5-bis (alkyldithio)-1,3,5-thiadiazole, (ii) at least one ring-alkylated diphenylamine, (iii) at least one sterically-hindered tertiary butyl phenol, (iv) at least one calcium sulfurized alkylphenate, (v) at least on alkyloxypropylamine, (vi) at least one aliphatic monocarboxylic acid, (vii) at least one alkyl glycol nonionic surfactant, and (viii) silicone foam inhibitor.

20. A composition in accordance with claim 1 wherein said friction modifier comprises at least one N-aliphatic hydrocarbyl-substituted diethanol amine in which the N-aliphatic hydrocarbyl-substituent is at least one straight chain aliphatic hydrocarbyl group free of acetylenic unsaturation and having in the range of 14 to 20 carbon atoms.

21. An automatic transmission fluid composition wherein said composition has on a weight basis an oil-soluble boron content of about 0.001 to about 0.1%, an oil-soluble phosphorus content of about 0.005 to about 0.2%, and an oil-soluble metal content as one or more metal-containing additives of no more than about 100 ppm; wherein said composition comprises:

a) at least about 70 wt % based on the total weight of said composition of one or more hydrogenated poly-α-olefin oligomer fluids, wherein this component a): (1) has a viscosity in the range of about 4 to about 6 cSt at 100° C.; (2) contains on a weight basis not more than a minor amount of species above hexamer, if any; and (3) is the only poly-α-olefin oligomer fluid in said composition;

b) on an active ingredient basis, about 2 to about 20 wt % based on the total weight of said composition of an acrylic viscosity index improver in the form of a solution in an inert solvent, wherein said viscosity index improver exhibits a permanent shear stability index using ASTM test method D-3945a of no higher than about 35;

c) about 4 to about 25 wt % based on the total weight of said composition of at least one oil-soluble dialkyl ester of a $C_6$ to $C_{10}$ α,ω-dicarboxylic acid having a pour point of −45° C. or lower;

d) a dispersant amount of at least one oil-soluble phosphorus-containing ashless dispersant;

e) a friction modifying amount of at least one oil-soluble friction modifier; and f) at least one oil-soluble foam inhibitor, at least one oil-soluble copper corrosion inhibitor, at least one oil-soluble rust inhibitor, and at least one oil-soluble oxidation inhibitor;

with the proviso that said power transmission fluid composition:

(A) has (i) a kinematic viscosity of at least 6.8 cSt at 100° C., (ii) a Brookfield viscosity of 15,000 cP or less at −40° C., (iii) a kinematic viscosity at 100° C. of at least 6.0 cSt after 4 hours in the Volkswagen taper roller bearing shear stability test, and (iv) a kinematic viscosity at 100° C. of at least 5.0 cSt after 20 hours in the Volkswagen taper roller bearing shear stability test; and (B) passes all of the seal tests set forth in the DEXRON® III specifications of General Motors Corporation and all of the seal tests set forth in the MERCON® specifications of Ford Motor Company.

22. A composition in accordance with claim 21 wherein said oil-soluble phosphorus-containing ashless dispersant is an oil-soluble boron- and phosphorus-containing ashless dispersant; wherein said friction modifier comprises at least one N-aliphatic hydrocarbyl-substituted diethanol amine in which the N-aliphatic hydrocarbyl-substituent is at least one straight chain aliphatic hydrocarbyl group free of acetylenic unsaturation and having in the range of 14 to 20 carbon atoms; and wherein said inhibitors of f) include (i) in the range of about 0.1 to about 1.0 wt % of at least one 1,3,5-thiadiazole copper corrosion inhibitor and (ii) in the range of about 0.01 to about 0.1 wt % of calcium sulfurized alkylphenate, these components (i) and (ii) being the only sulfur-containing additive components in said composition.

23. A composition in accordance with claim 22 wherein all of the boron content of said composition is supplied by said oil-soluble boron- and phosphorus-containing ashless dispersant.

24. A composition in accordance with claim 23 wherein all of the phosphorus content of said composition is supplied by said oil-soluble boron- and phosphorus-containing ashless dispersant.

25. A composition in accordance with claim 24 wherein said calcium sulfurized alkylphenate is the only metal-containing additive component in said composition.

* * * * *

UNITED STATES PATENT AND TRADEMARK OFFICE

CERTIFICATE OF CORRECTION

PATENT NO. : 5,891,786

DATED : 4/6/99

INVENTOR(S) : Sanjay Srinivasan et al.

It is certified that error appears in the above-indentified patent and that said Letters Patent is hereby corrected as shown below:

Column 2, line 4 - change "rush" to -- rust --;

Column 2, line 19 - change "baud" to -- band --;

Column 3, line 55 - change "rush" to --rust --;

Column 16, line 28 - delete "(le;5q)";

Table 3, line 45 - change "+27.43" to -- +4.02 --;

Column 17, line 36 - change "0.6" to -- 6.0 --.

Signed and Sealed this

Thirty-first Day of August, 1999

*Attest:*

Q. TODD DICKINSON

*Attesting Officer*

*Acting Commissioner of Patents and Trademarks*